US005678262A

United States Patent [19]

Tomlinson

[11] Patent Number: 5,678,262

[45] Date of Patent: Oct. 21, 1997

[54] TICK WITH CORDING FOR PILLOWS

[75] Inventor: John D. Tomlinson, Seattle, Wash.

[73] Assignee: Pacific Coast Feather Company, Seattle, Wash.

[21] Appl. No.: 636,553

[22] Filed: Apr. 23, 1996

[51] Int. Cl.[6] ..... A47G 9/00; A47C 31/00

[52] U.S. Cl. ..... 5/490; 5/657.5

[58] Field of Search ..... 5/490, 657.5, 739

[56] References Cited

U.S. PATENT DOCUMENTS 2,770,816 11/1956 Reisner ..... 5/657.5

2,865,435 12/1958 Bramson et al. ..... 5/657.5

3,940,812 3/1976 Zapf ..... 5/657.5

*Primary Examiner*—Alexander Grosz

[57] ABSTRACT

The article includes first and second fabric sections which are sewn together around their peripheries, with sections of cording in between. Four successive separate sections of cording extend cumulatively around the periphery of the tick, between the two fabric sections, extending somewhat outward from the periphery of the tick. The cording is covered with a bias tape material which is sewn between the first and second fabric sections, providing a stable physical relationship between the first and second fabric sections and the covered cording.

8 Claims, 2 Drawing Sheets

TICK WITH CORDING FOR PILLOWS

TECHNICAL FIELD

This invention relates generally to pillows, and more specifically concerns the tick (cover) portion of pillows.

BACKGROUND OF THE INVENTION

The more expensive, high quality pillows have in the past often included a small diameter cording around the periphery of the pillow tick. This cording, covered with a bias material, was typically sewn into the tick between the two large cloth pieces which generally comprise the tick. This arrangement had an attractive appearance and considerable customer appeal. However, manufacture of a tick with cording required some handling of the tick during manufacture by an operator, i.e. such a tick was not possible to manufacture automatically. Operator steps generally reduce the speed of manufacture of the tick, and increase the expense. Accordingly, the use of cording has been eliminated from many, if not most, pillow ticks, even though it still provides an attractive, finished appearance for the pillow. It would hence be desirable if cording could be sewn into a pillow tick during automatic manufacture thereof.

DISCLOSURE OF THE INVENTION

Accordingly, the present invention is a pillow tick with cording, comprising: a first, lower fabric section; a second, upper fabric section; separate sections of cording extending around the periphery of the tick, overlapping each other, typically at the corners thereof, wherein said sections of cording are covered by cover portions, the sections of cording and their associated cover portions being sewn between the first and second fabric sections, such that the covered cording is slightly outboard of the peripheries of the first and second fabric sections.

BEST MODE FOR CARRYING OUT THE INVENTION

As indicated above, the term "tick" refers to the cover portion of a pillow into which various kinds of filling material (among them down, feathers, polyester fiber, sponge rubber and others) are inserted to complete the pillow. The article of the present invention, including its particular construction, can best be understood by a description of the steps in its manufacture.

Figure 1:
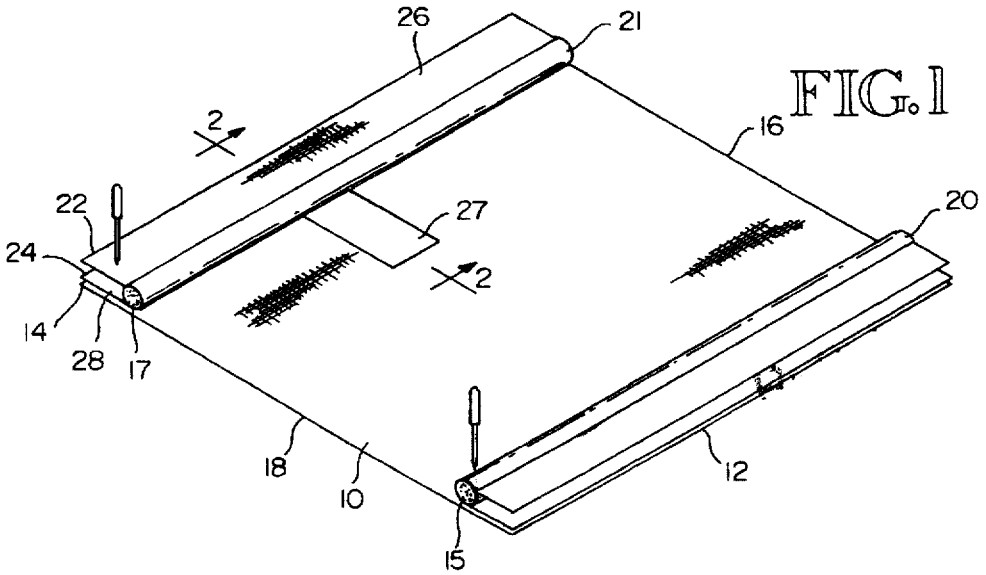
FIG. 1 is an isometric view of the pillow tick of the present invention in a first stage of manufacture.
Figure 2:
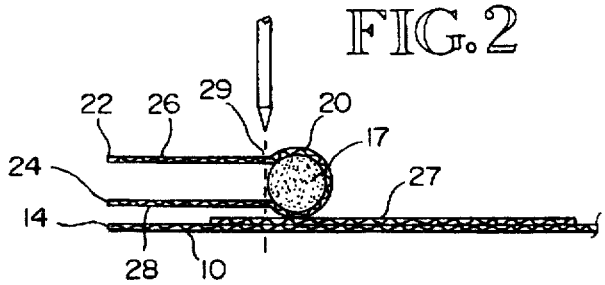
FIG. 2 is a cross-sectional view of a portion of FIG. 1.
Figure 3:
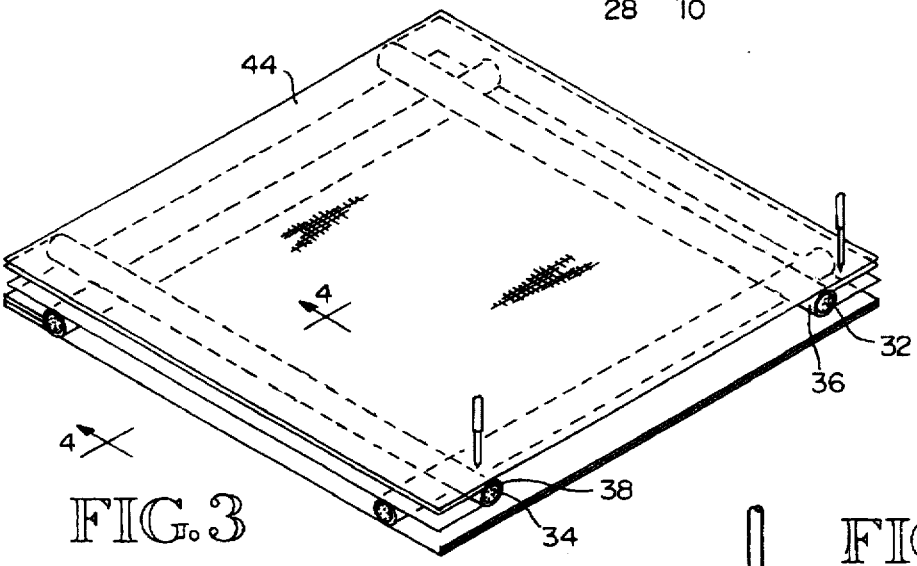
FIG. 3 is an isometric view of the pillow tick of the present invention in a second stage of manufacture.

Referring to FIGS. 1 and 2, a first fabric section 10 is positioned so that its "good" side is up, i.e. the side which is to be the exterior surface of the tick when the manufacture of the pillow is completed. The size of the fabric section will vary depending upon the desired final size of the pillow. Typically, the fabric section will be rectangular in shape, although it could certainly have other configurations. The fabric section may be any one of a variety of fabrics, including cotton, nylon or various combinations of natural and synthetic fabrics.

Positioned approximately at each end 12 and 14 of fabric section 10 are separate lengths of cording material 15, 17 extending approximately between opposing sides 16 and 18 of fabric section 10. The cording 15 is conventional cording fabric, approximately 3/32inch in diameter in the embodiment shown. The size and shape of cording 15 can be varied. Lengths of cover cloth 20, 21 such as conventional bias tape are folded about the cording sections, e.g. section 17, arranged so that the free longitudinal edges 22, 24 thereof extend away from the cording, terminating approximately at the respective ends 12 and 14 of fabric section 10 . Hence, there is defined upper and lower portions 26, 28 of each cording cover section.

The upper and lower portions 26, 28 of each cording cover section are sewn together and to fabric section 10 by a line of stitching 29 positioned adjacent the cording, between the cording and the adjacent end of fabric section 10. Hence, cording 17 is tightly captured in the folded-around and sewn cording cloth section. A label 27 may also be sewn in. This is shown more clearly in FIG. 2. The line of stitching may be accomplished by any conventional sewing machine, or a sewing machine which has been programmed for automatic action. The same procedure is used for cording 15 at the other end of the fabric section.

The next step in the manufacture of the pillow tick of the present invention includes positioning two additional (third and fourth) separate cording sections 32 and 34 along the sides 16 and 18 of fabric section 10. Cording sections 32 and 34 generally extend for the full length of the fabric section and overlap the first and second cording sections in the vicinity of each corner of the fabric section. Cording covers 36 and 38, respectively, are folded around the third and fourth cording sections, in similar fashion to the folding of cording covers around the first and second cording sections, with the upper and lower portions of each cording section extending a short distance away from the cording sections, terminating at approximately the longitudinal sides 16, 18 of fabric section 10.

Next, an upper fabric section 44 substantially identical to fabric section 10 is positioned in registry with fabric section 10, on top of the four cording sections which are basically arranged into a square with overlapped corner portions.

Figure 4:
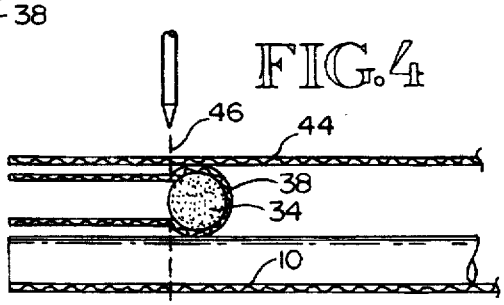
FIG. 4 is a cross-sectional view of a portion of FIG. 3.

Upper fabric section 44 is then sewn to the cording covers 36, 38 and fabric section 10. Lines of stitching are located adjacent cording sections 32 and 34 between the cording section and the edges of the fabric sections. The lines of stitching, e.g. line of stitching 46 adjacent cording section 34, secure together, from top to bottom, the upper fabric section 44, the upper and lower portions of cording cover 38 and sections of the upper and lower portions of cording covers 24 and 26 (where the cording covers 24 and 26 overlap cording covers 36 and 38) and the lower fabric section 10. This is shown most clearly in FIG. 4. An interior volume is thus defined between the upper and lower fabric sections, with the two opposing sides of the tick being closed at this point by line of stitching 46 and the similar line of stitching adjacent cording section 32. The two ends of the tick, however, are still open. The side edges of the tick may be serged at this point, to prevent raveling of the edges.

Figure 5:
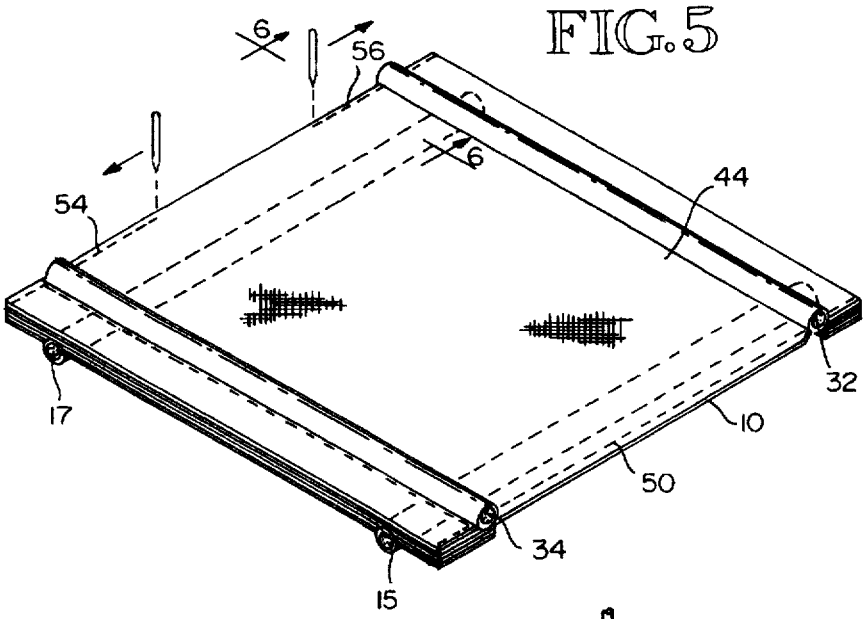
FIG. 5 is an isometric view of the pillow tick of the present invention in a third and final stage of its manufacture.
Figure 6:
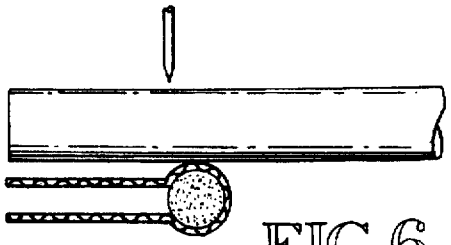
FIG. 6 is a cross-sectional view of FIG. 5.

FIGS. 5 and 6 show the last steps in the manufacture of the tick. This step includes a line of stitching 50 adjacent cording section 15. This line of stitching completely closes one end of the tick, so that only the other end is still open. At the other end, lines of stitching 54 and 56 extend slightly inwardly from the two opposing side edges of the tick, past the cording sections 32 and 34, resulting in a partial closing of the other end of the tick.

At the conclusion of this step, the tick of the present invention is basically complete, with four separate cording sections being enclosed in folded cording cover sections and sewn between upper and lower fabric sections. The sewn tick defines an interior volume with three completely closed sides and the other side partially open to permit filling of the pillow.

Figure 7:
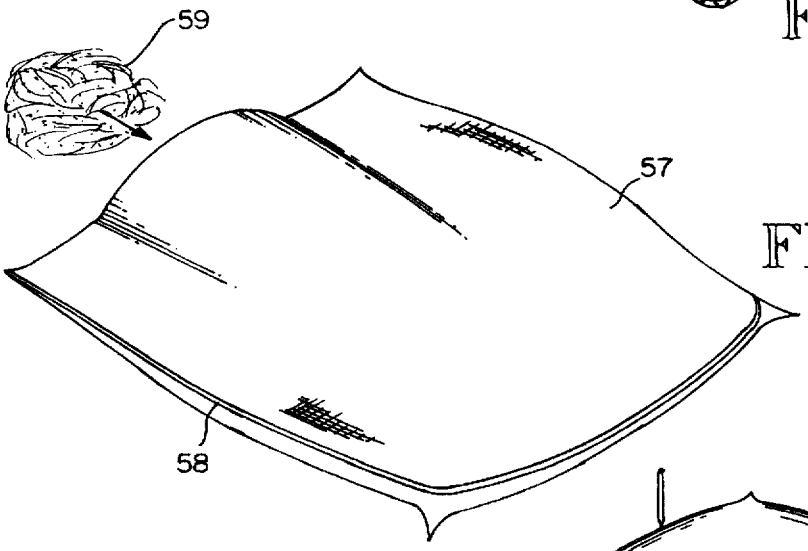
FIG. 7 shows the pillow tick of the present invention being filled.
Figure 8:
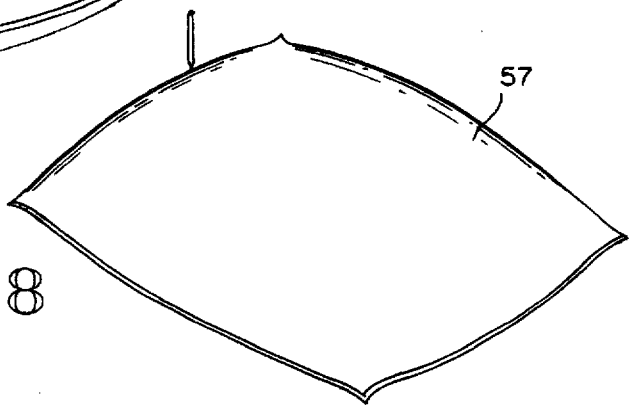
FIG. 8 is an isometric view showing a completed pillow using a pillow tick of the present invention.

To fill the tick 57, referring to FIG. 7, the tick is first turned inside-out, so that the covered cording 58 is now on the exterior of the tick. This, as indicated above, provides a distinctive, high quality appearance to the finished pillow. The tick is then filled with selected material 59 such as down, feathers, polyester fiber or other material. The partially open end is then sewn completely shut and the pillow is finished.

The particular physical arrangement of the components of the pillow tick described above, using four separate, overlapped cording sections, permits the completely automatic manufacture of the pillow tick. Automatic manufacture saves both time and expense.

Although a preferred embodiment of the invention has been disclosed herein for illustration, it should be understood that various changes, modifications and substitutions may be incorporated in such embodiment without departing from the spirit of the invention, which is defined by the claims which follow.

What is claimed is:

1. A tick with cording for a pillow, comprising:

a first, lower fabric section;

first and second sections of cording positioned across the lower fabric section at opposing ends of the lower fabric section, wherein the first and second cording sections include elongated first cover portions which are folded about the first and second cording sections;

lines of stitching connecting the cover portions and the lower fabric section, located adjacent the first and second cording sections;

third and fourth cording sections positioned at longitudinal sides of the lower fabric section, extending for approximately the length of the lower fabric section and overlapping the first and second cording sections, wherein the third and fourth cording sections include elongated second cover portions folded about the third and fourth cording sections;

a second, upper fabric section having approximately the same size and shape as the first fabric section, positioned in registry with the first fabric section on top of the first, second, third and fourth cording sections;

third and fourth lines of stitching adjacent the third and fourth cording sections, connecting together the upper and lower fabric sections, the second cover portions and end sections of the first cover portions; and a fifth line of stitching at one end of the first and second fabric sections, connecting together the first and second fabric sections, the first cover portions and end sections of the second cover portions, wherein the first, second, third and fourth cording sections thereby form a band around the periphery of the pillow tick between the first and second fabric sections.

2. An article of claim 1, wherein the lines of stitching are along an interior side of each cording section.

3. An article of claim 1, including a sixth line of stitching along a portion of the other end of the first and second fabric sections, connecting the first and second fabric sections and the first, second, third and fourth cover portions.

4. An article of claim 3, wherein the sixth line of stitching includes two separate portions, each portion extending from a side of the fabric sections a relatively short distance.

5. An article of claim 1, wherein side edges of said first and second fabric sections are sewn together by serging.

6. An article of claim 1, wherein the first and second cover portions comprise bias tape material.

7. An article of claim 1, wherein the cording sections have a diameter of approximately 3/32 inch.

8. A tick with cording for a pillow, comprising:

a first, lower fabric section;

a second, upper fabric section;

separate sections of cording which overlap at corners of the tick, the sections of cording extending around the periphery of the tick, said sections of cording being covered by cover portions, wherein said sections of cording and their associated cover portions are sewn between the first and second fabric sections, such that the covered cording is slightly outboard of the peripheries of the first and second fabric sections.

* * * * *